United States Patent [19]

Johnston

[11] Patent Number: 4,921,420

[45] Date of Patent: May 1, 1990

[54] CHILD RESISTANT DISPOSABLE LIGHTER

[76] Inventor: James A. Johnston, 1711 Poudre Canyon, Bellvue, Colo. 80512

[21] Appl. No.: 214,752

[22] Filed: Jul. 5, 1988

[51] Int. Cl.[5] ..... F23D 11/36

[52] U.S. Cl. ..... 431/153; 431/344; 222/153; 222/402.11; 222/402.12; 222/509; 222/518

[58] Field of Search ..... 431/153, 255, 344; 222/153, 402.11, 384, 402.12, 509, 518

[56] References Cited

U.S. PATENT DOCUMENTS

| | | | |
|---|---|---|---|
| 2,035,886 | 3/1936 | Holtzman . | |
| 2,520,328 | 8/1950 | Nissen | 431/153 X |
| 3,157,038 | 11/1964 | Gilberton | 431/277 X |
| 3,898,031 | 8/1975 | Rusakowicz | 431/754 |
| 3,989,445 | 11/1976 | Kojima | 431/344 X |
| 4,144,018 | 3/1979 | Tanaka | 431/150 |
| 4,784,602 | 11/1988 | Nitta | 431/153 |
| 4,786,248 | 11/1988 | Nitta | 431/153 X |
| 4,799,877 | 1/1989 | Bisbee | 431/153 |

*Primary Examiner*—Carl D. Price
*Attorney, Agent, or Firm*—Luke Santangelo

[57] ABSTRACT

A child resistant disposable lighter is disclosed. The design utilizes a safety mechanism which is designed to be difficult for small children to operate and which may be inexpensively and efficiently incorporated into existing disposable lighter designs. The design is presented in several embodiments which have improved effectiveness by operating with regard to anatomical differences rather than solely increasing the strength required to operate such a lighter. Embodiments include mechanisms which utilize a release means that is separated from the conventional lighting means by a sufficient distance to make it difficult for small children to operate. By also focusing on commercial realities, the invention is designed to be easily implemented on a cost efficient basis by existing manufacturers through only a minor modification of existing molds and assembly techniques.

23 Claims, 3 Drawing Sheets

CHILD RESISTANT DISPOSABLE LIGHTER

BACKGROUND OF THE INVENTION

Generally, the invention relates to a device which improves the safety of disposable lighters. This device focuses on the need for child safety together with the need to easily and inexpensively manufacture the device. It addresses these aspects by providing designs which are easily adapted to existing disposable lighters, and by providing a design which efficiently addresses the differences between adult and child manipulation of disposable lighters.

For many years disposable lighters have been commonplace in almost every household. The commercial success and consumer appeal of these disposable products is perhaps best realized when it is understood that it has been estimated that in excess of 500,000,000 disposable lighters are used each year. This commercial success is not without its drawbacks. Perhaps because of the widespread availability of disposable lighters, there has been a pressing need to address the safety of such lighters in the hands of small children. This need has naturally grown over time and has become so pressing that in 1985 it was the subject of a petition to the Consumer Products Safety Commission requesting that disposable lighters be required to be child resistant. In a recent report on the status of this petition, it was noted that over the six year period from 1980 through 1985 the need for a child resistant design was well known as approximately 730 deaths were the result of child-play with lighters. The extent to which this need was recognized can perhaps be even more directly shown by the fact that in one year alone, child-play with lighters accounted for an estimated 7,800 fires, 120 deaths, 860 injuries and $60.5 million dollars in property damage. An estimate of the annual average cost of the deaths, injuries, and property damage from child-play with lighters has been estimated to be approximately 310 to 375 million dollars each year. Of these incidents, studies have shown that 96% of them involved disposable butane lighters and 90% of the children were less than six years old.

In spite of the well-understood and broad extent of this need, no solution has as yet been proposed which adequately addresses both the need with respect to children and the commercial realities of implementing a solution on an efficient basis. Although designs have been developed in the past which address a safety issue, the focus of these designs has been inadvertent ignition rather than intentional ignition by children. Also, these designs have not been directed to the practicalities incidental to disposable rather than refillable lighters. In contrast to the present invention, the fact that these designs have accommodated refillable lighters has drastically changed the focus from an inexpensive and efficient device to durable, machined products. In addition, the focus on inadvertent rather than intentional ignition of the lighters has, in virtually every instance, failed to result in substantial benefit for the issue of child-play with disposable lighters. This is an important difference between those prior efforts and the present invention. Although the present invention, through its focus on child safety, has as an incidental benefit on inadvertent ignition, those prior efforts directed toward inadvertent ignition had minimal effect on child safety.

As an example, in U.S. Pat. No. 2,035,886 issued in 1936, a device was designed which related not to disposable lighters but rather to a permanent lighter. That permanent lighter did not have safety as one of its objects but rather was designed for convenience purposes in that it would automatically light when picked up. Obviously, the danger of unintentionally knocking over the lighter would actually reduce safety of the device rather than enhance the safety of lighters in general.

In 1950, through U.S. Pat. No. 2,520,328, a desire for a safety mechanism in refillable lighters was noted. This involved the typical portable, refillable lighter of the time and incorporated a mechanical safety mechanism which was very durable. Nothing of this design addressed the peculiar needs of children as the safety issue involved was not that if intentional ignition by children but rather inadvertent ignition by the user him or herself. Nothing in this design addressed the need for disposibility; in fact, the opposite seems to be true. The design proposed through this patent was not one which could be easily adapted to existing disposable designs as it is quite complex, would be difficult to assemble, and might even cost more to implement than the disposable lighters themselves.

In 1975, U.S. Pat. No. 3,898,031 was issued which also addressed the need for safety in refillable lighters. Again, the type of safety issue focused on was inadvertent ignition. Although ignition by small children was mentioned incidentally, the way that design operated showed that to focus was inadvertent ignition, "such as when the lighter is being carried in an individual's pocket" with only a secondary advantage being that the design was more difficult to operate for children. Although this design did mention simplicity as an object, this was in the context of ease of operation and reliability rather than ease of assembly and voluntary implementation on a commercial basis. It was designed to be "rugged . . . to withstand many years of intended usage" rather than on a disposable basis.

Finally, the recent invention set forth in U.S. Pat. No. 4,144,018 in 1979 was directed not to safety but rather to ease of use. That lighter used hypergolic fuel and therefore incorporated an interlock mechanism whose purpose was to prevent inadvertent exposure of the fuel to air (causing flame). No safety considerations are apparent and nothing in the design addresses the peculiar needs of a disposable device.

As can be seen from studies attached to the Consumer Safety Product Commission report entitled "Cigarette Lighter Petition, PP 85-2, November, 1987", none of these designs properly addressed the peculiar differences in physiology between adults and children. They would not appear to have actually been child resistant to the degree dictated by the present need.

The present invention addresses the long felt need of providing a child resistant disposable lighter. Although this need has been known for many years and involves a problem of substantial magnitude (as much as %375 million dollars a year), prior to the present invention no design existed which was both practical and effective and which properly balanced the competing interests of effectiveness with respect to children and cost and ease of use for adults on a disposable basis. Although the problem addressed through the present invention has been appreciated for some time, it would appear that the focus of those skilled in the art has actually taught away from the techniques and factors involved. As can be seen in the Consumer Products Safety Commission report, those skilled in the art have been focusing primarily on the striking mechanism of disposable lighters—not a separate release mechanism. Even in the earlier patented efforts which used a separate release mechanism, teachings of those skilled in the art were directed away from the peculiar needs of a disposable device and rather are designed for permanent and durable usage. These efforts perhaps seem to be caused primarily by the fact that those skilled in the art failed to see that intentional, not inadvertent, ignition was the problem and that those skilled inthe art failed to properly address the balance necessary for a disposable unit.

The device presented here appears to present a solution which is unexpectedly simple in use, manufacture, and implementation. Until the present invention nothing addressed the unique interplay of child safety while not adversely affecting the desire for adults to have a disposable lighter which was easy to operate and at the same time addressed the practical requirement of affording a design that was inexpensive, easily assembled, and readily manufactured through minor modification of existing techniques and molds.

SUMMARY OF THE INVENTION

It is an object of the present invention to provide a device which effectively and efficiently increases the difficulty for small children to operate the product. At the same time it is an object of the invention not to increase the difficulty for adults to operate the product. This object includes focusing on the physiological differences between adults and children under the age of six.

It is also an object of the present invention to provide a design which can be easily and inexpensively implemented consistent with the fact that its implementation will be on disposable units. To achieve this, it is an object to provide a design which may be molded, which may be added to existing designs with only minor modification, and which can be easily assembled in mass quantities.

By virtue of the disposable character of the subject product, it is of course an object of the present invention to allow for a design which is inexpensive to produce as measured in relation to the current costs of manufacturing disposable lighters.

In addressing the need for a child resistant lighter, it is an object of the present invention to use the physiological differences between a child and an adult and to focus on differences of this character which are uniformly extreme.

It is also an object of the present invention to provide a method to manufacture a child resistant disposable lighter through only minor modification of existing techniques and molds.

Naturally, further objects of the invention are disclosed in other areas of the specification and claims.

DETAILED DESCRIPTION OF THE PREFERRED EMBODIMENTS

Figure 1:
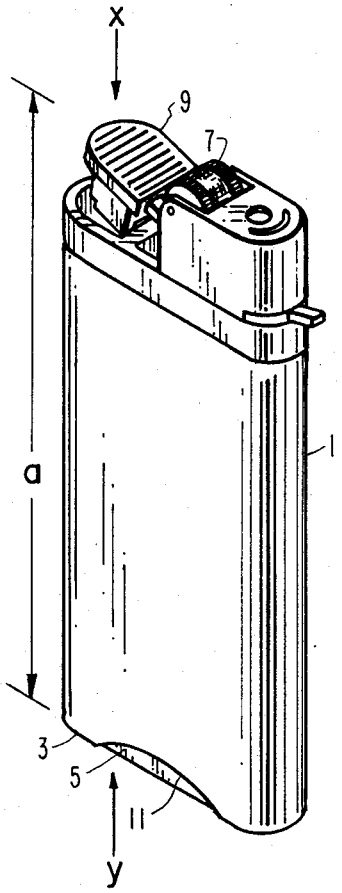
FIG. 1 is a perspective view of an embodiment of the invention showing the external appearance as implemented in a popular disposable lighter.

As can be seen from the drawings, the basic concepts of the present invention may be embodied in different ways. Referring to FIG. 1, the perspective view, it can be seen that the safety device results in only minor modification from an external perspective. FIG. 1 shows a popular disposable lighter, in this case a lighter similar to the SCRIPTO ® model produced by Scripto Tokai, Inc., which has been modified to provide the features of the present invention. As shown in FIG. 1, the lighter is of conventional design; however, its length (a) has been extended not only to accommodate the safety apparatus without reducing the volume for fuel, but also to provide for one aspect of the apparatus—namely, separating the release mechanism from the actuation mechanism. Other than this elongation of body (1), the only externally visual difference is that bottom end (3) of body (1) has inserted into it a means for releasing the safety mechanism, in this case a button (5). As in almost every disposable lighter, operation is through rotating a striking wheel (7) and then depressing an actuation lever (9). The actuation lever (9) is displaced in a direction (x) to release fuel. At the bottom end (3) of body (1), button (5) is depressed at some time prior to depressing actuation lever (9). Such movement of button (5) is in a direction (y) which is directly opposite that of direction (x) inwhich actuation lever (9) is displaced. By having such forces in direct opposition, operation is eased by balancing the lighter between forces.

Figure 2:
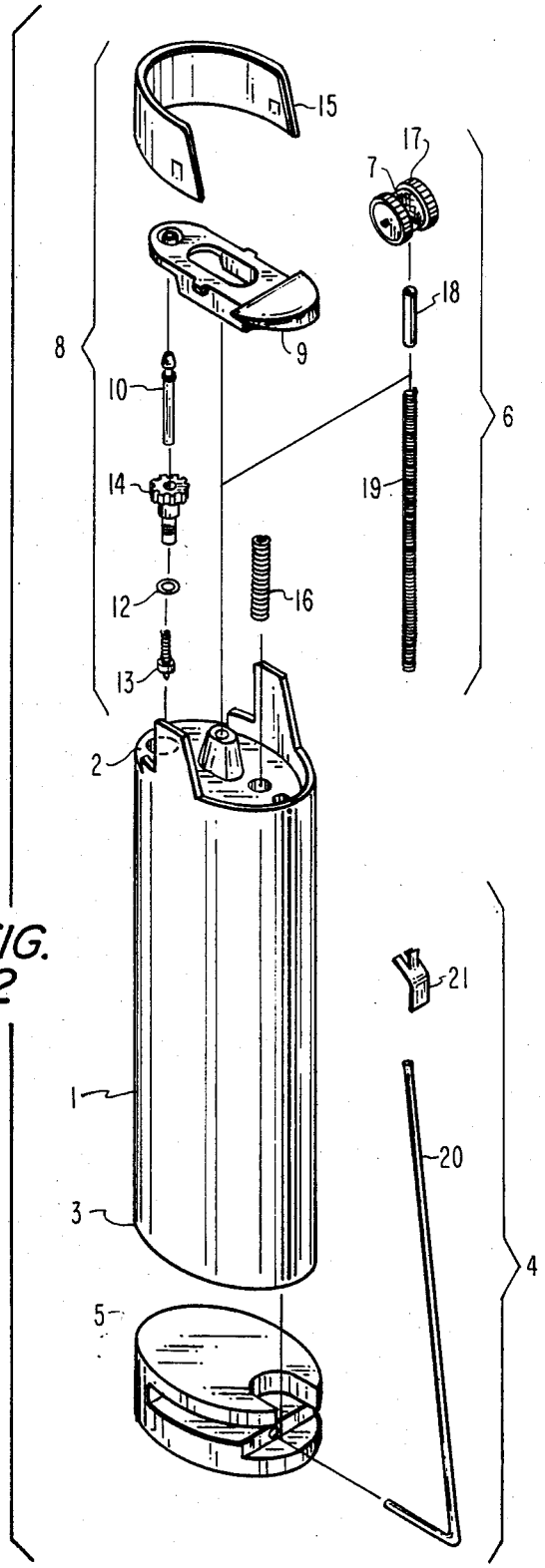
FIG. 2 is an exploded view of a similar embodiment with a flat bottom as implemented in another popular disposable lighter.

The details of the embodiment shown in FIG. 1 are more clearly shown in FIG. 2, an exploded view of a similar embodiment with one minor change. The differences between that shown in FIG. 2 and the embodiment shown in FIG. 1 are, first that the drawing of FIG. 2 depicts incorporation of the embodiment in a BIC ® lighter as produced by the BIC Corporation, and second that in FIG. 1 bottom end (3) of body (1) has a curved portion (11), whereas in FIG. 2 bottom end (3) of body (1) is flat. Functionally, the difference between these two is that while curved portion (11) shown in FIG. 1 facilitates operation as will be discussed later, the flat bottom shown in FIG. 2 requires an additional manipulation by the user in order to depress button (5) within body (1). This manipulation, while easier for adults, is much more difficult for small children due to the smaller size of their hands and their less developed manual dexterity.

Referring to the details of FIG. 2, it can be seen that top end (2) of body (1) is of relatively conventional design and incorporates the standard features. As can be seen from disassembly of the BIC ® lighter, the top end of the lighter generally includes a means for controlling the release of gas (8), and a means for creating a spark (6). In the present invention, there is added a means for preventing operation (4).

The means for controlling the release of gas incorporates actuation lever (9) which is connected to flame tube (10) with use of O-ring (12). A gas valve is created through a beveled valve set (13) and a sealed retaining nut (14). This control mechanism is then covered by a shield enclosure (15). Actuation lever (9) serves to release gas and operate the means for controlling the release of gas (8) when depressed. An actuator spring (16) then serves to automatically return the means for controlling the release of gas (8) to the off position upon release. The means for creating a spark (6) is also of conventional design and incorporates striking wheel (7) which has knurled edges (17). This operates on a flint (18) which is held against striking wheel (7) by a flint spring (19).

The addition to the conventional design in this embodiment lies not only in the lengthening of the body (1) as discussed earlier but also in the inclusion of a means for preventing operation (4). This means includes a modification to the body (1) (discussed later in reference to FIG. 8), a button (5), a rod (20), and a safety catch (21).

Figure 3:
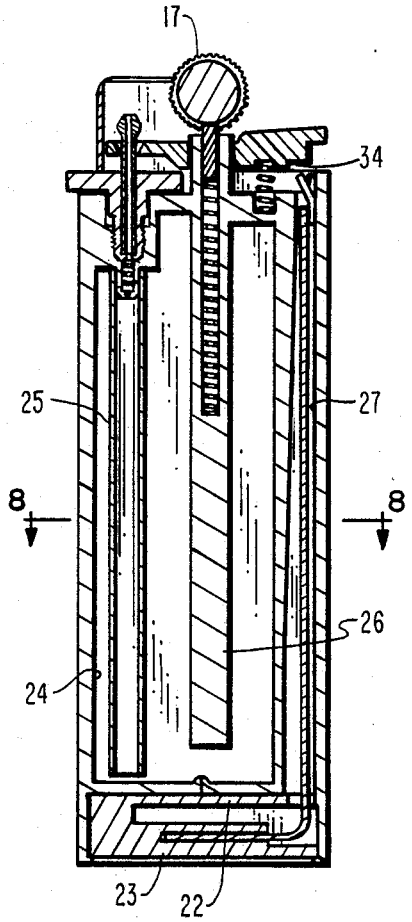
FIG. 3 is a cross sectional view of the embodiment shown in FIG. 2.
Figure 5:
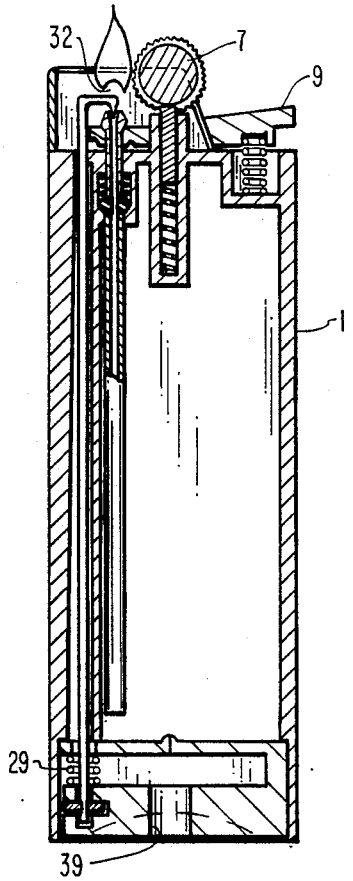
FIG. 5 is a cross sectional view of an alternative embodiment which also prevents the valve from opening and which has a separate spring to operate the means for preventing operation.

Referring now to FIG. 3, a cross sectional view of the embodiment shown in FIG. 2, the operation of the present invention can be understood as follows. In normal operation, typical disposable lighters are operated by rotating striking wheel (7) and then depressing actuation lever (9). In the present invention such steps alone would not result in ignition of the lighter. Because of interference by the means for preventing operation (4), actuation lever 9 would not be completely depressed in direction (x). Rather, safety catch (21) would be positioned underneath actuation lever (9). By allowing some depression of actuation lever (9), small children may confuse failure to operate the device with an empty lighter, thus stopping further attempts by them at ignition. Naturally, the amount of such movement should be consistent with the amount possible on the other end of actuation lever (9). In this fashion, means for controlling release of gas (8) will not release gas until means for preventing operation (4) has been properly activated. To properly ignite the lighter, means for preventing operation (4) would first need to be activated. This would be accomplished by depressing button (5) in direction (y). Such displacement of button (5) longitudinally displaces rod (20) which would then laterally displace safety catch (21) away from actuation lever (9). This would result in allowing actuation lever (9) to be fully depressed thus resulting in ignition of the lighter. After operation is complete, the fact that rod (20) is bent at right angles acts as an automatic return mechanism thus, immediately allowing safety catch (21) to reposition itself in the "safe" position so as to again interfere with actuation lever (9). Naturally, in this configuration rod (20) should be made of material which has spring-like properties. Also, as can be easily understood other shapes of rod (20) are possible to allow for this spring action; for instance, the bottom of rod (20) could be bent similar to a safety-pin to provide sufficient return characteristics. Also, a separate spring can be utilized, as shown in FIG. 5, to return the means for preventing operation to the "safe" position. To keep safety catch (21) from being overridden by force when in the safe position, a lip (34) may be provided on actuation lever (9). Since actuation lever (9) is usually molded, lip (34) may be a negative lip as shown. To allow for inexpensive modification of existing molds, a positive lip is also possible. As one type of means for keeping the safety feature from being overridden, the lip keeps one from being able to force actuation lever down without first operating button (5). Otherwise safety catch (21) might bend down if sufficient force were applied.

As can be seen, button (5) may be easily molded to have both a cap portion (22) and a movable portion (23). Cap portion (22) would thus serve to enclose body (1) in the vicinity of bottom end (3) as is currently done to seal the volume which holds the fuel substance. Movable portion (23) of button (5) would thus serve to operate means for preventing operation (4). Naturally, cap portion (22) could merely be placed against existing caps in conventional lighters; or, as in the Scripto® lighter, the cap could be integrally molded onto body (1). In addition, button (5) may include variations in design to allow access for filling the lighter after assembly. As an example, but without limitation, a variation as shown in FIG. 2 is possible. Since BIC® lighters currently have an access port in their bottom caps, such port is accommodate through a separate bottom integral to body (1). An access port may also be provided as part of button (5). Naturally, in such a variation, rod (20) will need to be bent or positioned along the side of button (5) so as not to interfere with button hole (39) if this design is used. This type of variation is shown in simplified form in FIG. 5.

As can be easily appreciated from the exploded view in FIG. 2, assembly of means for preventing operation (4) can be easily accomplished by positioning safety catch (21) in place on top end (2) of body (1) and then assembling the remainder of means for controlling release of gas (8) and means for creating a spark (6) conventionally. Means for preventing operation (4) is then added by inserting rod (20) into button (5) and inserting this assembly into body (1). Button (5) is then held in place by known techniques such as gluing, snapping it in to place, and the like. Safety catch (21) incorporates some type of spring or other flexible means to automatically return it to its "safe" position underneath actuation lever (9) once rod (20) retracts itself. As shown, such flexible means is incorporated into the design of safety catch (21). In addition rod (20) could be bent in the vicinity of safety catch (21) to provide lateral displacement when moved in the direction (y).

Figure 8:
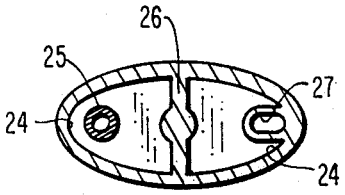
FIG. 8 is a cross sectional view of the body of the disposable lighter across plane 8—8 in FIG. 2.

FIG. 8, a cross-sectional view of body (1), shows that body (1) has inner sides (24). On one inner side (24) there is a fuel tube (25) which is of conventional design to allow operation of the unit while in the vertical position. Also of conventional design is the inclusion of a reinforcement baffle (26). Added to the conventional design is a molded channel (27). Unlike prior designs, molded channel (27) is positioned along one inner side (24). In this way, the inclusion of molded channel (27) has as small an impact on the reduction of volume available for fuel as possible. Since rod (20) is designed to fit within molded channel (27) and since rod (20) may have a small degree of lateral movement, molded channel (27) may be slightly oval to accommodate such lateral movement. Molded channel (27) may be tapered as shown in FIG. 3 to facilitate assembly and molding of the device.

As mentioned earlier, body (1) may be slightly elongated to adequately distance button (5) from actuation lever (9). This distance (a) allows for the practical needs of expansion of the volume for fuel within body (1) to offset the loss caused by inclusion of molded channel (27) and providing space within which to fit button (5). Elongating body (1) also has the functional impact of adequately displacing button (5) from actuation lever (9) by distance (a). This key feature provides for child resistance because of the size of the hands of children under the age of six. As was noted in the Consumer Products Safety Commission report, most children under the age of six find it necessary to use two hands to operate conventional disposable lighters. Since it appears that the maximum distance between the extended thumb and curled little finger of a child under the age of six appears to be approximately 3⅝ inches, by separating actuation lever (9) from button (5) by at least this distance, children who would have to use two hands to merely strike the flame will not be able to activate means for preventing operation (4).

In addition, elongation along distance (a) by some minimal amount also serves to force a small child who is attempting to operate the child resistant disposable lighter to use his or her thumb in the fully extended position and will force the child to use his or her little finger in attempting to operate means for preventing operation (4). Both of these extremes tend to reduce the strength of operation and further make it more difficult for a small child to operate a disposable lighter. As can be seen from prior efforts of those skilled in the art, configuration in a fashion which weakens the forces a small child can exert was not considered. First, although as much as six pounds of force is capable of being generated by the thumb of a small child, in the extended position this amount of force will be greatly reduced. Also, as naturally positioned in the hand, the little finger will be used along its side to apply the force perpendicular to the finger itself. This is also a weaker movement. The present invention recognizes that by keying on the size and strength of small children's hands, the desired goal of providing child resistant disposable lighters can be efficiently achieved without undue impact on use of the lighter by adults.

Figure 4:
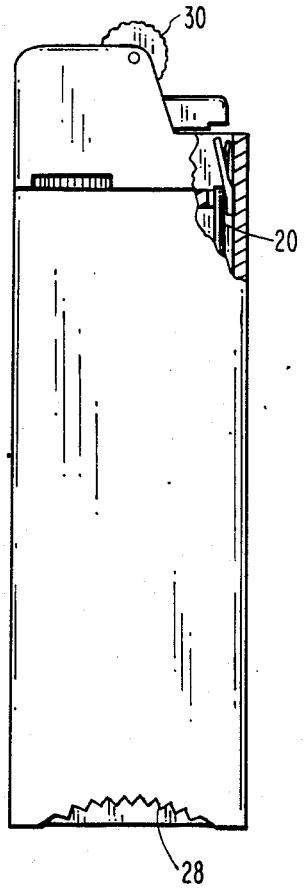
FIG. 4 is a cross sectional view of a similar embodiment with a sharp bottom, a means for increasing the striking force, and a separate spring, all as implemented on still another popular disposable lighter.

Referring again to FIG. 2, the exploded view, it can be seen that bottom end (3) of body (1) is flat. In contrast, as shown in FIG. 1, the perspective view, bottom end (3) of body (1) has curved portion (11). Curved portion (11) facilitates operation of means for preventing operation (4) by more easily allowing displacement of button (5) in direction (y) by the side of the operator's finger. In contrast, the flat bottom shown in FIG. 2 makes it necessary to reposition one's little finger to fit within bottom end (3) of body (1) in order to displace button (5). This naturally requires more controlled manipulation of the hand which small children are not easily capable of doing. Since the flat button does, however, make it slightly more difficult for adults to operate the lighter, curved portion (11) is also shown as a compromise between child resistance and ease of operation for adults. Referring to FIG. 4, the cross-sectional view with a sharp bottom, it can be seen that curved portion (11) may be replaced with a sharp bottom (28). Such sharp bottom (28) can be of various shapes and designs, its primary purpose being to increase the discomfort of operation for small children. Since in typical operation the side of the finger would depress button (5) and since the skin in this area is more sensitive for children than adults, sharp bottom (28) may allow ease of operation by adults while not greatly reducing the child resistance function of the device.

As can also be seen from FIG. 4 there are other minor features and variations in this embodiment. Rather than utilizing rod (20) to provide the means for automatically returing the safety mechanism, there is a separate means to return the safety catch. Naturally, this means may be in a variety of designs including an integrally molded returning means or a spring (29) as shown in FIG. 5. Since it may not be possible to generate sufficient force to key on the weakness of the little finger of small children economically by the use of only a bent rod (20), spring (29) and other methods are naturally available. In considering this feature of the design, it appears that such spring (29) should require at least 2½ pounds of force for operation as that amount seems the limit possible for lateral movement of the little finger of small children. This, again, adds to the many features providing child resistance. Such spring, of course, could be of varied design such as a coil or flat clip spring. It could also be integrally molded onto button (5) in many ways.

Also incorporated in the variation of this embodiment shown in FIG. 4, is a means for increasing the striking force. This means is accomplished by using a smoother striking wheel (30). This will accommodate teachings by those skilled in the art which have focused on increasing the force necessary to generate a spark. The force involved being that possible by the thumb of small children—a higher amount than that possible by lateral movement of the little finger of small children. Naturally other techniques are possible in conjunction with the present design. Finally, it should be noted that the variation shown in FIG. 4 also depicts this embodiment on still another popular lighter, in this case a CRICKET® lighter as manufactured by Universal Match Corp.

Referring now to FIG. 5, a cross sectional view of an alternative embodiment, it can be seen that a device which is independent of the operation of actuation lever (9) is possible. In this embodiment button (5) and rod (20) are of similar design; however, rod (20) passes through molded channel (27) on the other inner side (24) of body (1). Rod (20) is then designed so as to seal means for controlling release of gas (8) as a safety design. As can be seen rod (20) now includes a cone portion (31) which will not allow gas to release until means for preventing operation (4) is activated. For simplicity this embodiment is shown in FIG. (5) on a non-adjustable ligther. As is shown in more detail in FIG. (6) an expanded cross sectional view of the gas valve, cone portion (31) is lifted above means for controlling release of gas (8) by depressing button (5) in direction (y). In contrast to the prior embodiment, means for preventing operation (4) does not move laterally in use. Rather, cone portion (31) of rod (20) moves longitudinally into the gap (32) between means for controlling release of gas (8) and the flame. In this fashion the cone portion (31) of rod (20) experiences only minimal heating when the lighter is ignited for longer periods of time. Shape of shield enclosure (15) can also be varied to allow additional air flow and thus vary amount of gap (32) for ease of design.

Figure 6:
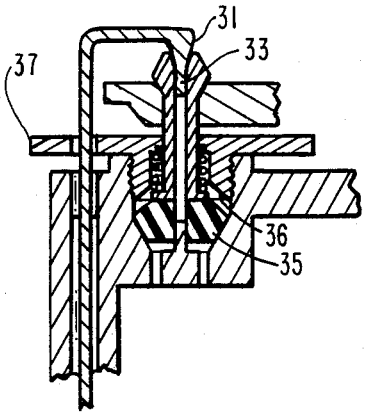
FIG. 6 is an expanded cross sectional view of the gas valve as incorporated in the embodiment shown in FIG. 5 and also having an alignment needle.

Referring now to the details of FIG. 6, the expanded view of this embodiment showing a minor variation, it can be seen that the primary difference between FIG. 5 and FIG. 6 is that in FIG. 6 the cone portion (31) of rod (20) includes an alignment needle (33). Alignment needle (33) extends into means for controlling release of gas (8) and thus serves to keep cone portion (31) of rod (20) optimally positioned for best sealing in the "safe" position. Naturally other techniques are possible to assure optimum positioning including flat rods and the like. Alignment needle (33) can also prevent rotation of rod (20). This can be particularly important when, as shown in FIG. 5, rod (20) does not extend in button (5) to prevent rotation. Because current designs of means for controlling release of gas (8) use a bevel (35) as part of the beveled valve set (13) when not in operation, this bevel (35) seals means for controlling release of gas (8) by positioning against sealed retaining nut (14). In like fashion cone portion (31) of rod (20) will seal as well with only small leakage. Because of the way current designs allow movement of beveled valve set (13), it may also be necessary to provide adequate sealing along bottom edge (36) of sealed retaining nut (14). In this fashion gas will not escape undesirably between sealed retaining nut (14) and beveled valve set (13). This embodiment also provides the advantage of stopping operation if means for preventin operation (4) is released during the operation phase. Naturally, a configuration as shown by this embodiment could be adapted to prevent operation of actuation lever (9) as well similar to the prior embodiment.

Figure 7:
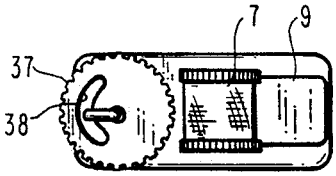
FIG. 7 is a top view of the gas release point of the embodiment shown in FIG. 6 with the flame guard removed.

Referring now to FIG. 7, the top view of this embodiment, it can be seen that in designs which incorporate an adjustable flame height by means of a flame adjustment wheel (37) there will need to be incorporated a curved slot (38) through which rod (20) may pass. As shown in the various figures, sealed retaining nut (14) may be designed to have flame adjustment wheel (37) integral to it. In designs which use an adjustment lever rather than an adjustment wheel, mutual reconfiguration of rod (20) and the adjustment lever is possible. Naturally, in order to allow accommodation of existing designs for both sealed retaining nuts (14), the means for controlling release of gas (8), or reconfiguration as mentioned, it may be desirable to increase the width of the lighter to allow extra distance in which to position molded channel (27) in this embodiment.

I claim:

1. A child resistant disposable safety lighter comprising:
   a. a body to contain a suitable flammable substance and having top and bottom ends and inner sides;
   b. a means for controlling the release of said substance said controlling mens having an actuation lever at the top end of said body; and
   c. a means for preventing the operation of said lighter which is molded into said body wherein said preventing means is accomplished at a point at least 3⅛ inches from said actuation lever.

2. A child resistant disposable safety lighter as described in claim 1 wherein said means for preventing has a central portion and is recessed into the body in the vicinity of said bottom end of the body and wherein said bottom end of the body is curved to facilitate access to the central portion of the means for preventing.

3. A child resistant disposable safety lighter as described in claim 1 wherein said means for preventing has an edge portion adjacent to said bottom end of the body and is recessed into the body in the vicinity of said bottom end of the body and wherein said bottom end of the body is flat to limit access to said edge portion of the preventing means.

4. A child resistant disposable safety lighter as described in claim 1 wherein said means for preventing is recessed into the body in the vicinity of said bottom end of the body and wherein said bottom end of the body is sharp to limit access to said preventing means.

5. A child resistant disposable safety lighter as described in claims 1 wherein said controlling means will cease to operate if said preventing means is released.

6. A child resistant disposable safety lighter comprising:
   a. a body to contain a suitable flammable substance and having top and bottom ends and inner sides;
   b. a means for controlling the release of said substance, said controlling means having an actuation lever at the top end of said body;
   c. a bottom cap to seal the bottom end of said body wherein said bottom cap releases said preventing means;
   d. a means for creating a spark adjacent to said controlling means; and
   e. a means for preventing the operation of said lighter wherein release of said preventing means is accomplished at a point at least 3⅛ inches from said actuation lever, and wherein said preventing means further comprises:
      i. a rod disposed within said body and between said actuation lever and said bottom cap;
      ii. a safety catch responsive to said rod and capable of preventing operation of said actuation lever; and
      iii. a means for automatically returning said preventing means to interfere with operation of the lighter after activation and wherein said returning means is integrally molded into said bottom cap.

7. A child resistant disposable safety lighter as described in claim 2 wherein said rod is also said returning means.

8. A child resistant disposable safety lighter as described in claim 6 and further comprising a means for keeping said preventing means from being overridden and wherein said means for keeping said preventing means from being overridden is a lip on said actuation lever.

9. A child resistant disposable safety lighter comprising:
   a. a body to contain a suitable flammable substance and having top and bottom ends and inner sides;
   b. a means for controlling the release of said substance wherein said controlling means has an actuationlever at the top end of said body and a gas outlet and wherein said release of the flammable substance occurs at the gas outlet;
   c. a bottom cap to seal the bottom end of said body wherein said bottom cap releases said preventing means;
   d. a means for creating a spark adjacent to said controlling means; and
   e. a means for preventing the operation of said lighter wherein release of said preventing means is accomplished at a point at least 3⅛ inches from said actuation lever, and wherein said preventing means further comprises:
      i. a rod disposed within said body and between said gas outlet and said bottom cap having a central axis and having first and second ends wherein said first end is responsive to said bottom cap;
      ii. an orthogonal member having a proximal and distal end wherein the proximal end is integral to the second end of the rod and wherein the orthogonal member is substantially perpendicular to the central axis of the rod;

iii. a conically shaped member attached to the distil end of the rod and capable of sealing said gas outlet to interfere with operation of the lighter; and iv. a means for automatically returning said preventing means to interfere with operation of the ligther upon release of said preventing means.

10. A child resistant disposable safety lighter as described in claim 9 and further comprising a means for keeping said rod cool upon lighting said child resistant disposable safety lighter.

11. A child resistant disposable safety ligther as described in claim 10 capable of producing a flame and wherein there exists a gap between said gas outlet and said flame when lit and wherein said means for keeping said rod cool is accomplished by locating one end of said rod within said gap.

12. A child resistant disposable safety ligther as described in claim 9 wherein said returning means is integrally molded into said bottom cap.

13. A child resistant disposable safety lighter as described in claim 9 wherein said rod is also said returning means.

14. A child resistant disposable safety lighter as described in claim 9 wherein said returning means comprises a spring.

15. A child resistant disposable safety lighter as described in claim 9 and further comprising a means for positioning said preventing means for optimal operation.

16. A child resistant disposable safety ligher as described in claim 15 wherein said positioning means comprises an alignment needle on one end of said rod.

17. A child resistant disposable safety lighter comprising:

a. a body to contain a suitable flammable substance and having top and bottom ends and inner sides;

b. a means for controlling the release of said substance, said controlling means having an actuation lever at the top end of said body;

c. a bottom cap to seal the bottom end of said body wherein said bottom cap releases said preventing means;

d. a means for creating a spark adjacent to said controlling means; and e. a means for preventing the operation of said lighter wherein release of said preventing means is accomplished at a point at least $3\frac{1}{8}$ inches from said actuation lever, and wherein said preventing means further comprises:

i. a rod disposed within said body and between said actuation lever and said bottom cap and responsive to said actuation lever; and ii. a means for automatically returning said preventing means to interfere with operation of the lighter after activation and wherein said returning means is integrally molded into said bottom cap.

18. A child resistant disposable safety lighter as described in claim 17 wherein said rod is also said returning means.

19. A child resistant disposable safety lighter as described in claim 17 wherein said returning means comprises a spring.

20. A child resistant disposable safety lighter as described in claim 17 and further comprising a means for retaining said preventing means from disengaging from said actuation lever until release of said preventing means.

21. A child resistant disposable safety lighter as described in claim 17 wherein said spark means requires a force of greater than 6 pounds to produce a spark.

22. A child resistant disposable safety lighter comprising:

a. a body to contain a suitable flammable substance and having top and bottom ends and inner sides;

b. a means for controlling the release of said substance, said controlling means having an actuation lever at the top end of said body;

c. a means for preventing the operation of said lighter which is molded into said body, and wherein release of said preventing means is accomplished at a point at least $3\frac{1}{8}$ inches from said actuation lever and wherein said preventing means is released by a force opposite to that necessary to operate said actuation lever;

d. a bottom cap to seal the bottom end of said body; and e. a means for creating a spark adjacent to said controlling means.

23. A child resistant disposable safety lighter as described in claim 17 wherein said retaining means is a lip on said actuation lever.

* * * * *